US008015936B2

(12) United States Patent
Sakaue et al.

(10) Patent No.: US 8,015,936 B2
(45) Date of Patent: Sep. 13, 2011

(54) ROWING BOAT FOOTREST ASSEMBLY

(75) Inventors: Atsushi Sakaue, Yamaguchi (JP); Keiji Matsueda, Yamaguchi (JP)

(73) Assignee: Shimano Inc., Osaka (JP)

( * ) Notice: Subject to any disclaimer, the term of this patent is extended or adjusted under 35 U.S.C. 154(b) by 177 days.

(21) Appl. No.: 12/361,594

(22) Filed: Jan. 29, 2009

(65) Prior Publication Data

US 2010/0186658 A1 Jul. 29, 2010

(51) Int. Cl.
*B63B 17/00* (2006.01)

(52) U.S. Cl. ..... 114/363

(58) Field of Classification Search ..... 114/153, 114/343, 347, 363; 440/101–110; 280/250.1, 280/291, 304.1; 297/344.1, 423.39–423.46; 482/73; 74/594.5
See application file for complete search history.

(56) References Cited

U.S. PATENT DOCUMENTS

| | | | | |
|---|---|---|---|---|
| 1,621,423 | A * | 3/1927 | Long | 114/363 |
| 2,033,637 | A | 3/1936 | Kaiser | |
| 3,202,435 | A * | 8/1965 | Goodman | 280/11.26 |
| 3,898,950 | A * | 8/1975 | Martin | 440/105 |
| 4,649,852 | A * | 3/1987 | Piantedosi | 114/363 |
| 5,367,976 | A | 11/1994 | Van Schaik | |
| 5,899,780 | A * | 5/1999 | Robbins | 440/105 |
| 6,109,988 | A | 8/2000 | Dunn, Jr. | |
| 6,745,643 | B2 | 6/2004 | Lubanski | |
| 6,939,186 | B1 | 9/2005 | Kuckes | |
| 7,552,695 | B1 * | 6/2009 | Matsueda et al. | 114/363 |
| 2005/0183654 | A1 | 8/2005 | Chambers | |
| 2006/0183385 | A1 | 8/2006 | Kaufer | |
| 2006/0292940 | A1 | 12/2006 | Ewans | |
| 2009/0205556 | A1 | 8/2009 | Kawahara et al. | |

FOREIGN PATENT DOCUMENTS

| | | |
|---|---|---|
| DE | 1 275 904 | 8/1968 |
| DE | 9 309 887 U | 8/1993 |
| DE | 4 324 864 A1 | 1/1995 |

OTHER PUBLICATIONS

Rotating Rowing Footstretcher; European Aluminium Award 2008; Industrical Design & Engineering; 2008.
German Office Action of corresponding German Application No. 10 2009 021 498.4-22 dated Feb. 15, 2011.

* cited by examiner

*Primary Examiner* — Daniel Venne
(74) *Attorney, Agent, or Firm* — Global IP Counselors, LLP

(57) ABSTRACT

A rowing boat footrest assembly is provided with a stationary boat mounting, a shoe support and a lateral adjustment mechanism. The stationary boat mounting structure is arranged to be coupled to a rowing boat, the stationary boat mounting structure. The first shoe support unit stationary boat mounting structure is arranged to be coupled to a rowing boat. The shoe support includes an attachment member adjustably coupled to the stationary boat mounting structure, and a footrest member attached to the attachment member. The lateral adjustment mechanism is disposed between the stationary boat mounting structure and the shoe support to slidably mount the shoe support on the stationary boat mounting structure. The lateral adjustment mechanism is arranged to selectively secure the shoe support in at least two different lateral foot positions with respect to the stationary boat mounting structure.

17 Claims, 18 Drawing Sheets

ROWING BOAT FOOTREST ASSEMBLY

BACKGROUND OF THE INVENTION

1. Field of the Invention

This invention generally relates to a rowing boat footrest assembly. More specifically, the present invention relates to a rowing boat footrest assembly in which the position of the footrest is adjustable.

2. Background Information

Rowing is becoming an increasingly more popular form of recreation. Moreover, rowing has become a very popular competitive sport for both amateurs and professionals. Whether rowing is for recreation or competition, the rowing industry is constantly improving the various components of rowing boats and equipment used by rowing enthusiasts. One component that has been extensively redesigned is the rowing boat footrest.

Traditionally, the footrest in a rowing boat is an angled surface upon which a rower can brace his or her feet to provide increased power during the rowing process. Recently, footrests have been provided with simple shoe retaining straps or mechanisms that hold a rower's shoe against the surface of the footrest. Typically, the footrest cannot move during the rowing back and forth stroke. In some instances, the location of the entire footrest is adjustable in the longitudinal direction of the rowing boat. Also, in some cases, the angle of the footrest is adjustable with respect to the rowing boat. However, the footrest is typical adjustable to accommodate different sizes of rowers.

In view of the above, it will be apparent to those skilled in the art from this disclosure that there exists a need for an improved footrest configuration that allows for more adjust to accommodate different sizes of rowers. This invention addresses this need in the art as well as other needs, which will become apparent to those skilled in the art from this disclosure.

SUMMARY OF THE INVENTION

One object of the present invention is to provide a rowing boat footrest assembly for a rowing boat with structure that allows the rower's footrest to be adjusted laterally to accommodate different sizes of rowers.

The foregoing objects can basically be attained by providing a rowing boat footrest assembly that basically comprises a stationary boat mounting, a shoe support and a lateral adjustment mechanism. The stationary boat mounting structure is arranged to be coupled to a rowing boat, the stationary boat mounting structure. The first shoe support unit stationary boat mounting structure is arranged to be coupled to a rowing boat. The shoe support includes an attachment member adjustably coupled to the stationary boat mounting structure, and a footrest member attached to the attachment member. The lateral adjustment mechanism is disposed between the stationary boat mounting structure and the shoe support to slidably mount the shoe support on the stationary boat mounting structure. The lateral adjustment mechanism is arranged to selectively secure the shoe support in at least two different lateral foot positions with respect to the stationary boat mounting structure.

These and other objects, features, aspects and advantages of the present invention will become apparent to those skilled in the art from the following detailed description, which, taken in conjunction with the annexed drawings, discloses a preferred embodiment.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
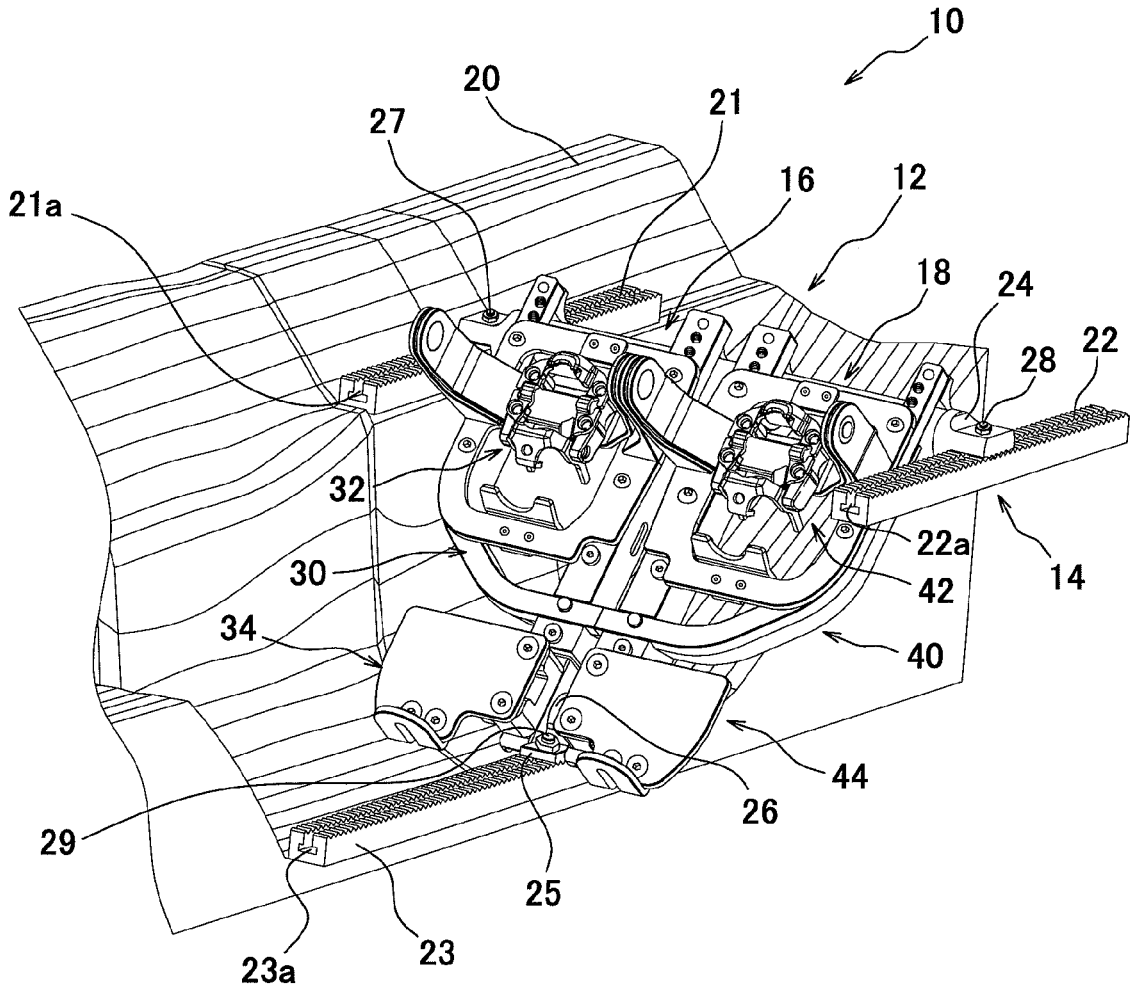
FIG. 1 is a partial perspective view of a portion of a hull of a rowing boat with a rowing boat footrest assembly in accordance with one embodiment.
Figure 2:
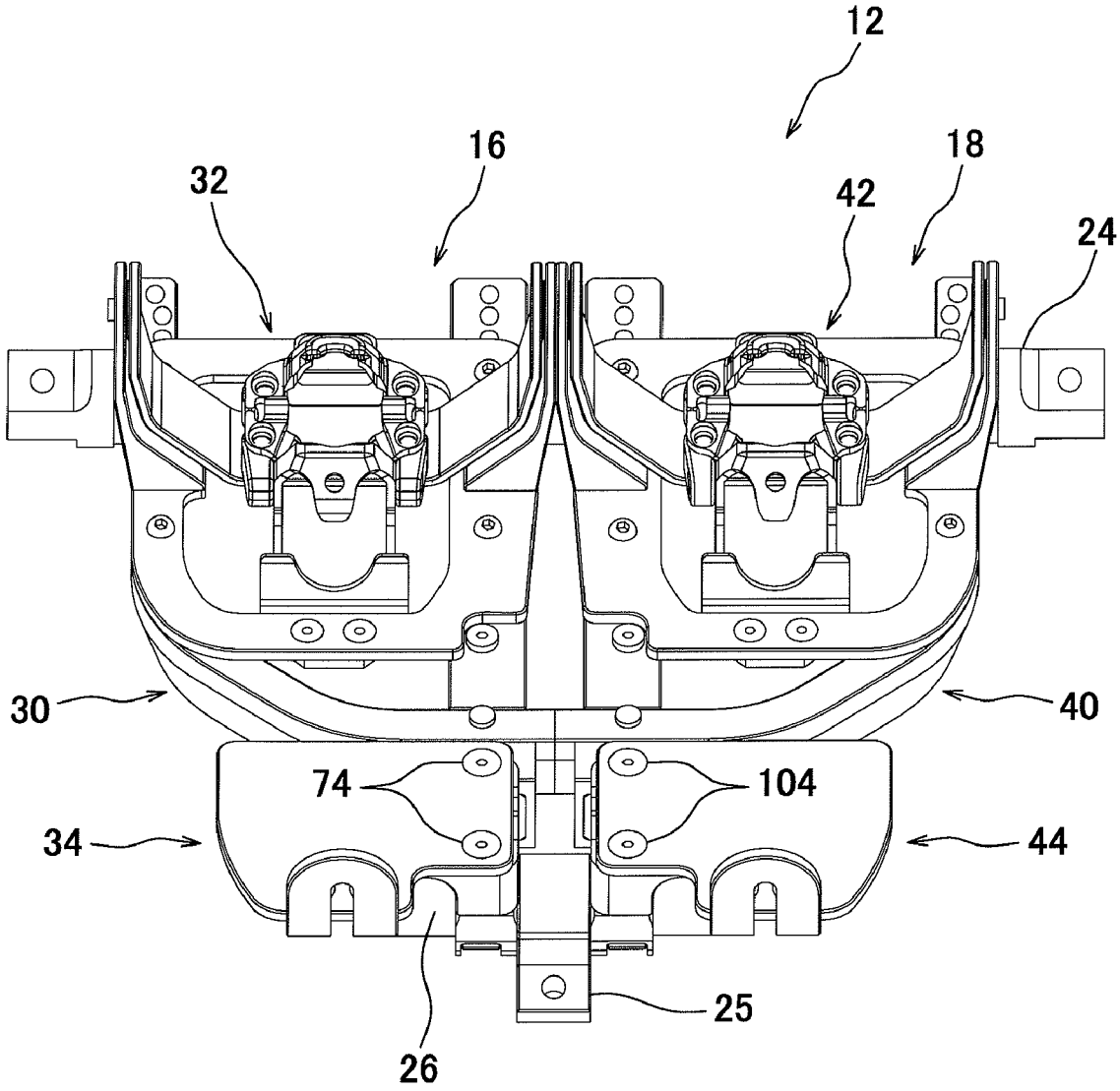
FIG. 2 is a front elevational view of the rowing boat footrest assembly in illustrated in FIG. 1.

Referring initially to FIG. 1, a portion of a rowing boat 10 is illustrated that is equipped with a rowing boat footrest assembly 12 in accordance with one embodiment. The rowing boat 10 can be any of a variety of boat where one or more persons is seated for rowing the rowing boat 10. Thus, one or more of the rowing boat footrest assembly 12 can be mounted in the rowing boat 10. For example, the rowing boat 10 can be a sweep-oar rowing boat where each rower has one oar held by both hand, or the rowing boat 10 can be a sculling rowing boat where each rower has two oars, with one oar held by each hand. The conventional oars of the rowing boat 10 are omitted for the sake of brevity and to provide greater clarity in the drawings. Likewise, other conventional parts (e.g., a sliding seat) of the rowing boat 10 are omitted for the sake of brevity.

The rowing boat footrest assembly 12 basically includes a stationary boat mounting structure 14, a first shoe support unit 16 and a second shoe support unit 18. The first and second shoe support units 16 and 18 collectively constitute a shoe support. The stationary boat mounting structure 14 is fixed directly to a hull 20 (only a portion is shown in FIG. 1) of the rowing boat 10. The first and second shoe support units 16 and 18 are adjustably coupled to the stationary boat mounting structure 14 in a lateral direction of the rowing boat 10 as explained below. Also, the first and second shoe support units 16 and 18 are adjustably in a longitudinal direction of the rowing boat 10 to accommodate rowers with different lengths of feet as explained below.

The stationary boat mounting structure 14 is a conventional structure that is rigidly fixed or rigidly supported to an interior portion or gunwale portion of the hull 20. The hull 20 can have any of a variety of conventional shapes and configurations depending upon whether the boat is a sweep-oar rowing boat or a sculling rowing boat. More specifically, the size and shape of the hull 20 can have any size and shape that can accommodate the rowing boat footrest assembly 12. It should be apparent to those skilled in the rowing boat field from the drawings and the description herein that the stationary boat mounting structure 14 can be a single structure supported or rigidly fixed to the hull 20, or alternatively can be two or more separated structures that are supported or rigidly fixed to the hull 20.

As seen in FIG. 1, the stationary boat mounting structure 14 basically includes a first side rail 21, a second side rail 22, a center rail 23, a lateral cross support member 24, a center support member 25 and a lateral cross support member 26. The stationary boat mounting structure 14 is arranged to be coupled to the rowing boat 10 as seen in FIG. 1. In particular, the first and second side rails 21 and 22 are fixedly arranged parallel to one another along the sides of the hull 20, with the center rail 23 being arranged parallel to first and second side rails 21 and 22 along a center of the floor of the hull 20. In the illustrated embodiment, the first and second side rails 21 and 22 are equidistant from the center rail 23. The first and second side rails 21 and 22 are rigidly fixed to opposite sides of the hull 20, with the lateral cross support member 24 adjustably mounted on the first and second side rails 21 and 22 by a pair of side rail fasteners 27 and 28, respectively. The center support member 25 is adjustably mounted to the center rail 23 by a center rail fastener 29. The rail fasteners 27, 28 and 29 are preferably a nut and bolt arrangement with the nut being slidably disposed in slots 21*a*, 22*a* and 23*a* of the rails 21, 22 and 23, respectively, such that the lateral cross support member 24 and the center support member 25 can be selectively position along the rails 21, 22 and 23. Thus, the longitudinal positions of the first and second shoe support units 16 and 18 can be longitudinally adjusted with respect to the hull 20 of the rowing boat 10. For example, a taller rower may want the footrest assembly 12 moved to a forward position closer to the bow of the rowing boat 10. Shorter rower may want to move the footrest assembly 12 to a more rearward position toward the stem of the rowing boat 10. Preferably, the ends of the lateral cross support member 24 and the bottom surface of the center support member 25 are provided with gear teeth that mate with gear teeth of the upper surface of the rails 21, 22 and 23, respectively. These mating gear teeth ensure that the lateral cross support member 24 and the center support member 25 are locked in a desired longitudinal position along the rails 21, 22 and 23. Thus, the rails 21, 22 and 23, the lateral cross support member 24, the center support member 25, the rail fasteners 27, 28 and 29 constitute a longitudinal adjustment mechanism for adjusting the longitudinal positions of the first and second shoe support units 16 and 18 with respect to the hull 20.

Figure 5:
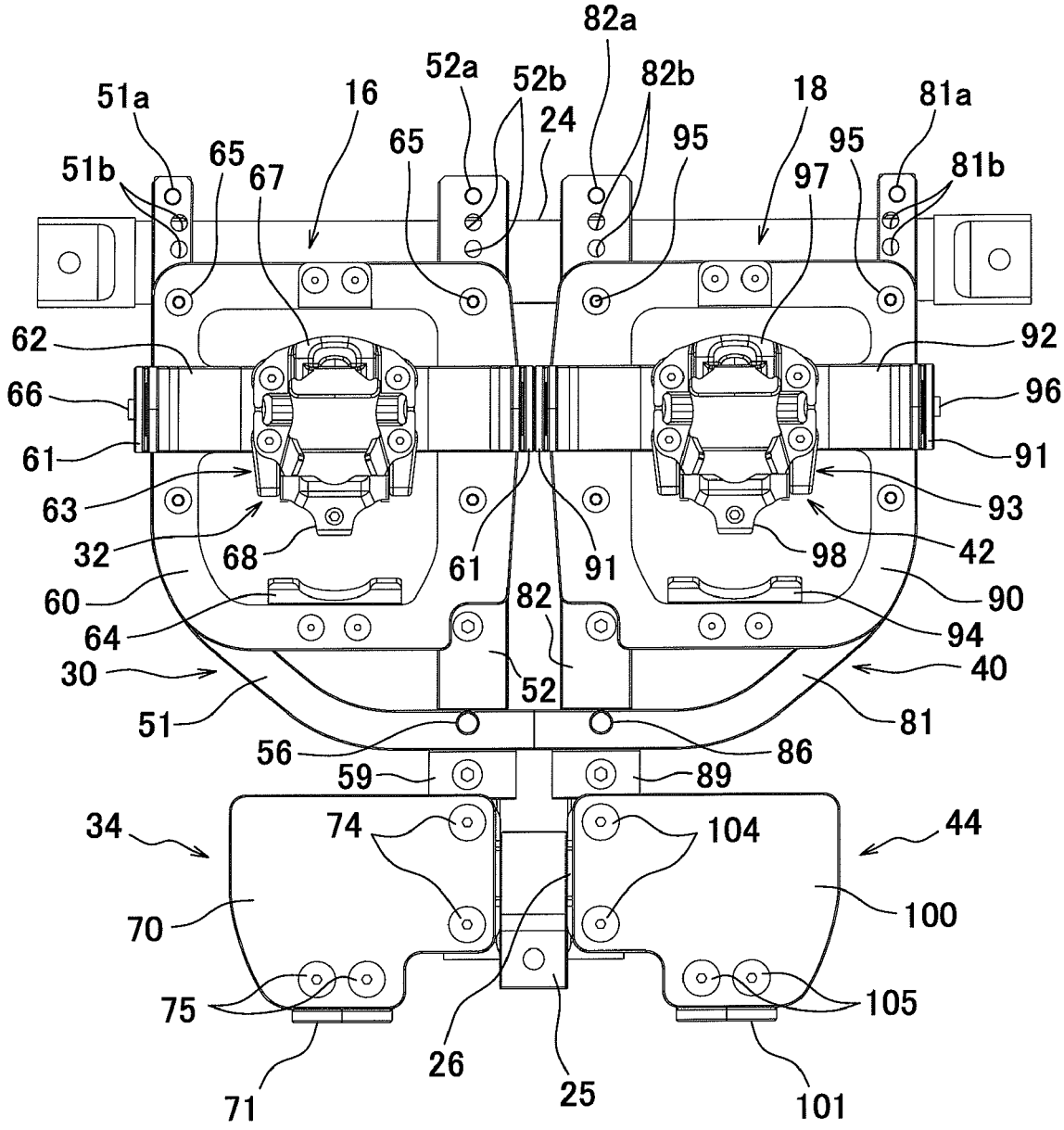
FIG. 5 is a top oblique view of the rowing boat footrest assembly illustrated in FIGS. 1 to 4, with the footrest parts in first lateral and longitudinal foot positions with respect to the stationary boat mounting structure, and with the heel support parts in first longitudinal heel positions with respect to the stationary boat mounting structure.
Figure 6:
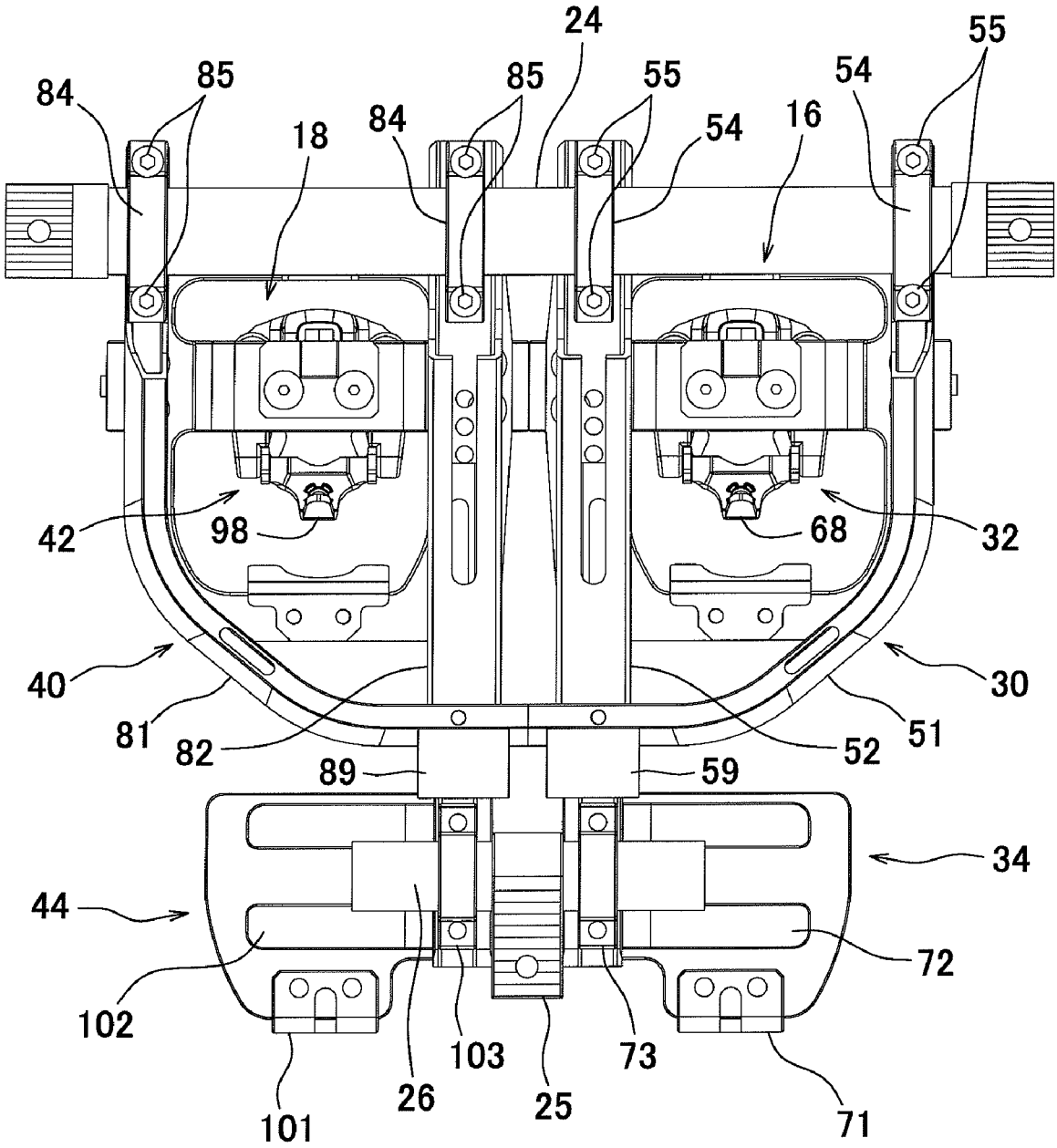
FIG. 6 is a bottom oblique view of the rowing boat footrest assembly illustrated in FIGS. 1 to 5, with the footrest parts in the first lateral and longitudinal foot positions with respect to the stationary boat mounting structure, and with the heel support parts in first longitudinal heel positions with respect to the stationary boat mounting structure.
Figure 7:
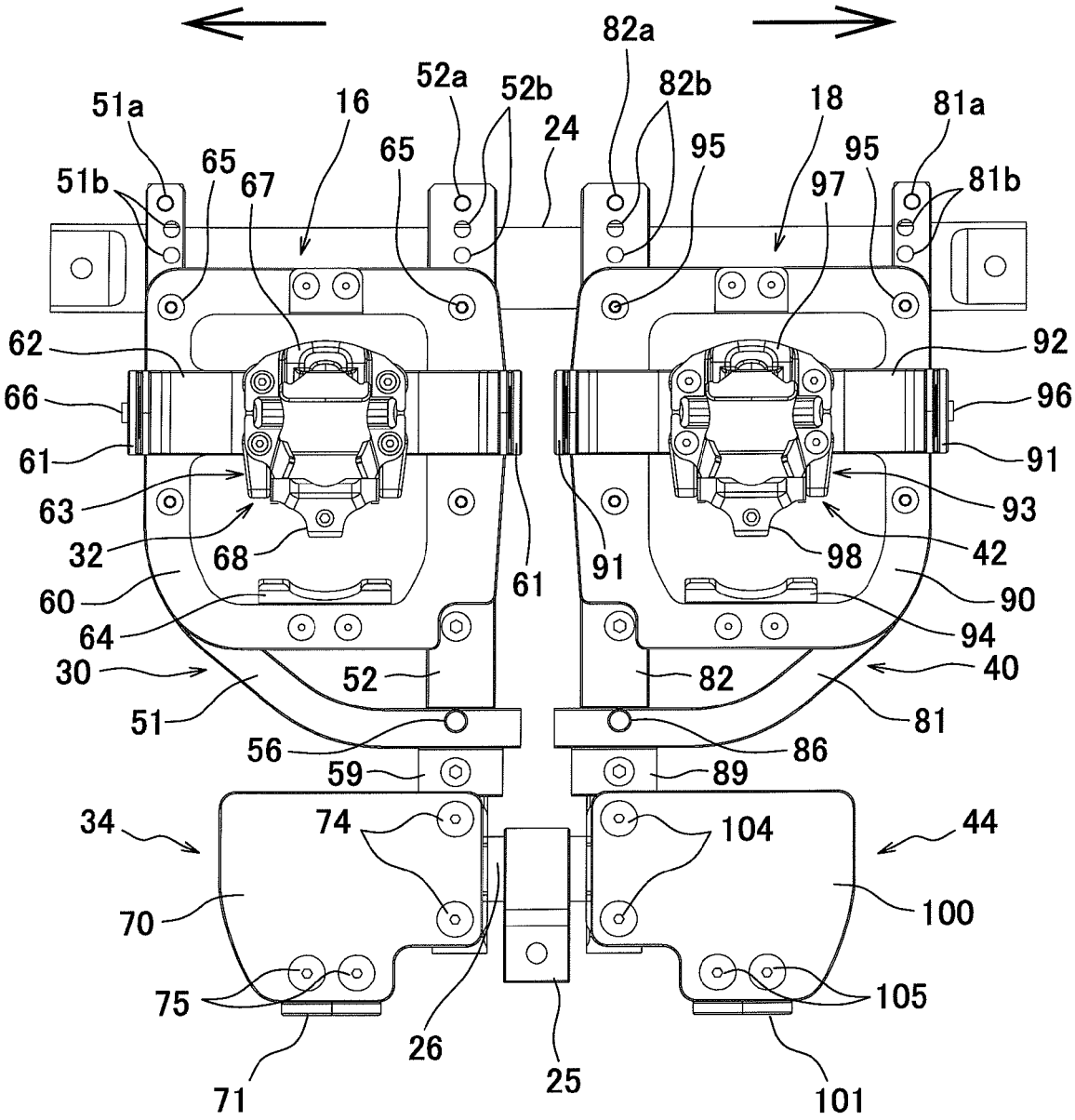
FIG. 7 is a top oblique view, similar to FIG. 5, of the rowing boat footrest assembly, but with the footrest parts in second lateral foot positions with respect to the stationary boat mounting structure.
Figure 8:
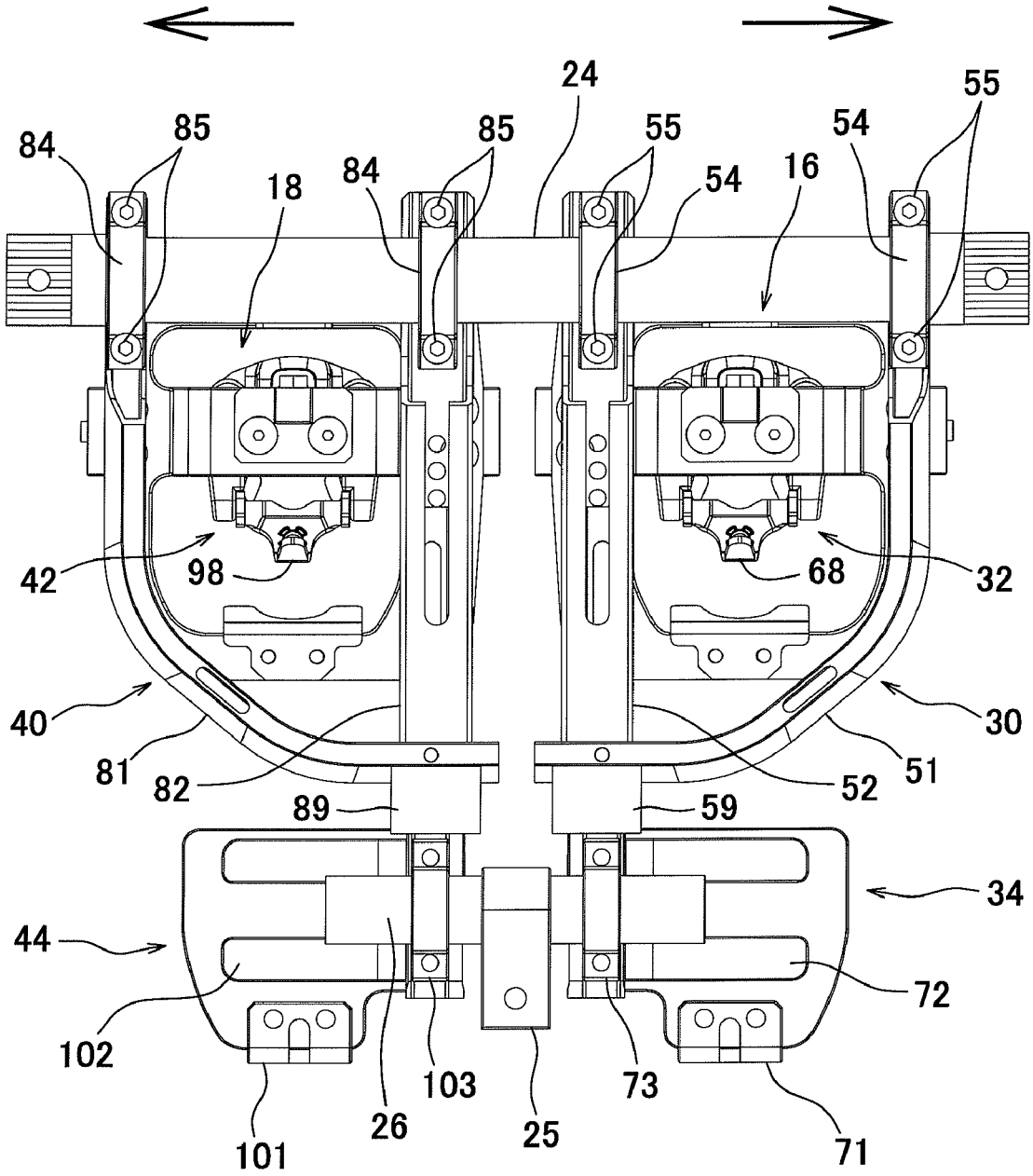
FIG. 8 is a bottom oblique view, similar to FIG. 6, of the rowing boat footrest assembly, but with the footrest parts in second lateral foot positions with respect to the stationary boat mounting structure.

As seen in FIGS. 5 to 8, the lateral cross support members 24 and 26 support the first and second shoe support units 16 and 18 for independent adjustment in the lateral direction of the rowing boat 10 to accommodate different lateral foot positions for a rower's feet. FIGS. 5 and 6 illustrate a first lateral foot position, while FIGS. 7 and 8 illustrate a second lateral foot position. While only two lateral foot positions are illustrated, it will be apparent to those skilled in the art from this disclosure that an infinite number of lateral foot positions exist for the first and second shoe support units 16 and 18 with respect to the stationary boat mounting structure 14, as explained below.

Basically, as best seen in FIGS. 5 to 10, the first shoe support unit 16 includes a first attachment part 30, a first footrest part 32 and a first heel support part 34. Similarly, the second shoe support unit 18 basically includes a second attachment part 40, a second footrest part 42 and a second heel support part 44. The second shoe support unit 18 is a mirror image of the first shoe support unit 16. The first and second attachment parts 30 and 40 collectively constitute an attachment member of the shoe support (i.e., the first and second shoe support units 16 and 18). The first and second footrest parts 32 and 42 collectively constitute a footrest member of the shoe support (i.e., the first and second shoe support units 16 and 18). The first and second heel support parts 34 and 44 collectively constitute a heel support member of the shoe support (i.e., the first and second shoe support units 16 and 18). In the illustrated embodiment, the first and second shoe support units 16 and 18 are independent units in which the first and second attachment parts 30 and 40 are independently adjustable in the lateral direction of the rowing boat 10, the first and second footrest parts 32 and 42 are independently adjustable in the longitudinal direction of the rowing boat 10, and the first and second heel support parts 34 and 44 are independently adjustable in the longitudinal direction of the rowing boat 10. However, it will be apparent to those skilled in the art from this disclosure that all of these adjustment features do not need to be included in the rowing boat footrest assembly 12. Rather, any combination of these adjustment features can be included in the rowing boat footrest assembly 12 as needed and/or desired.

Figure 9:
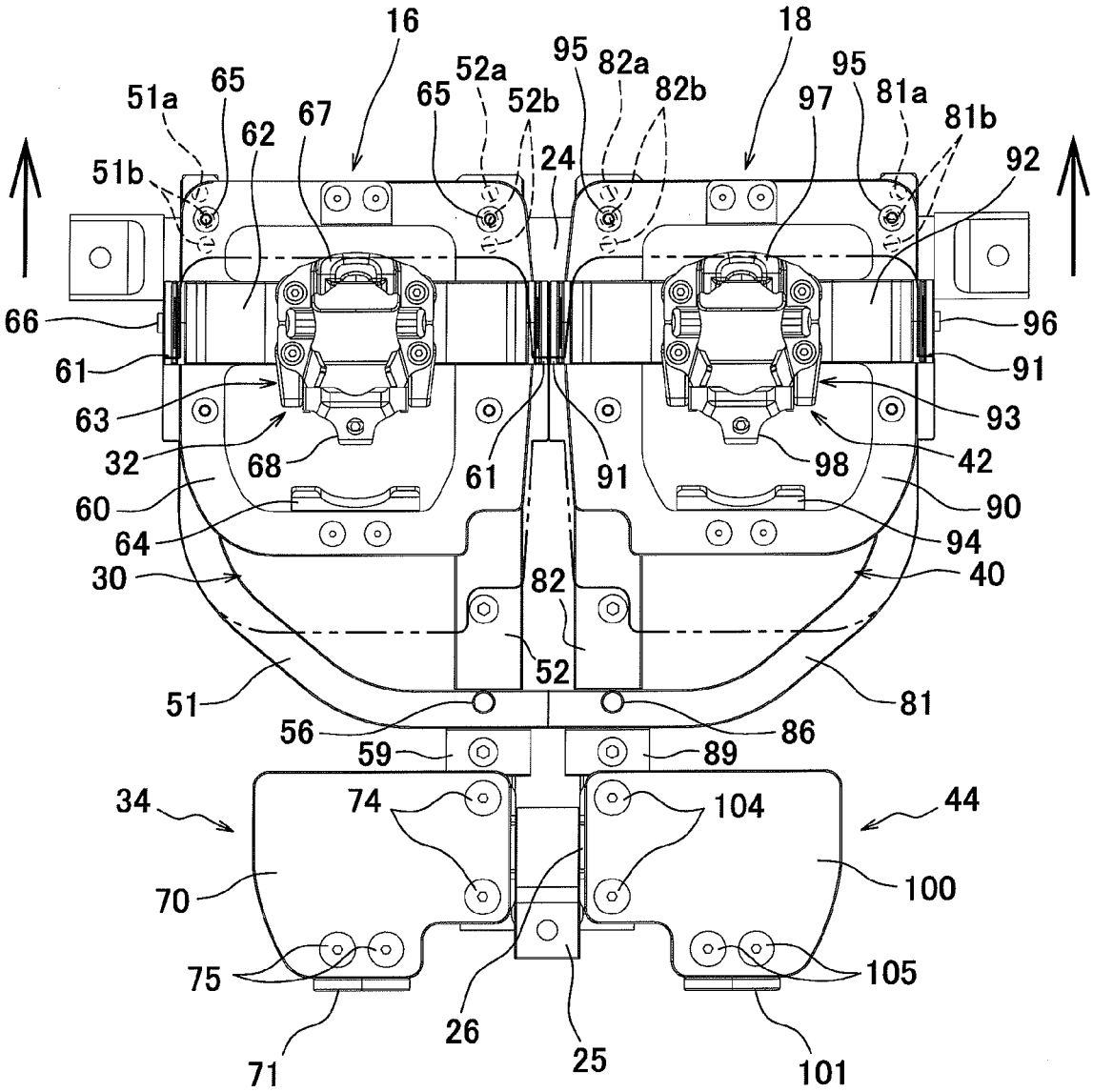
FIG. 9 is a top oblique view, similar to FIG. 5, of the rowing boat footrest assembly, but with the footrest parts in second longitudinal foot positions with respect to the stationary boat mounting structure.
Figure 10:
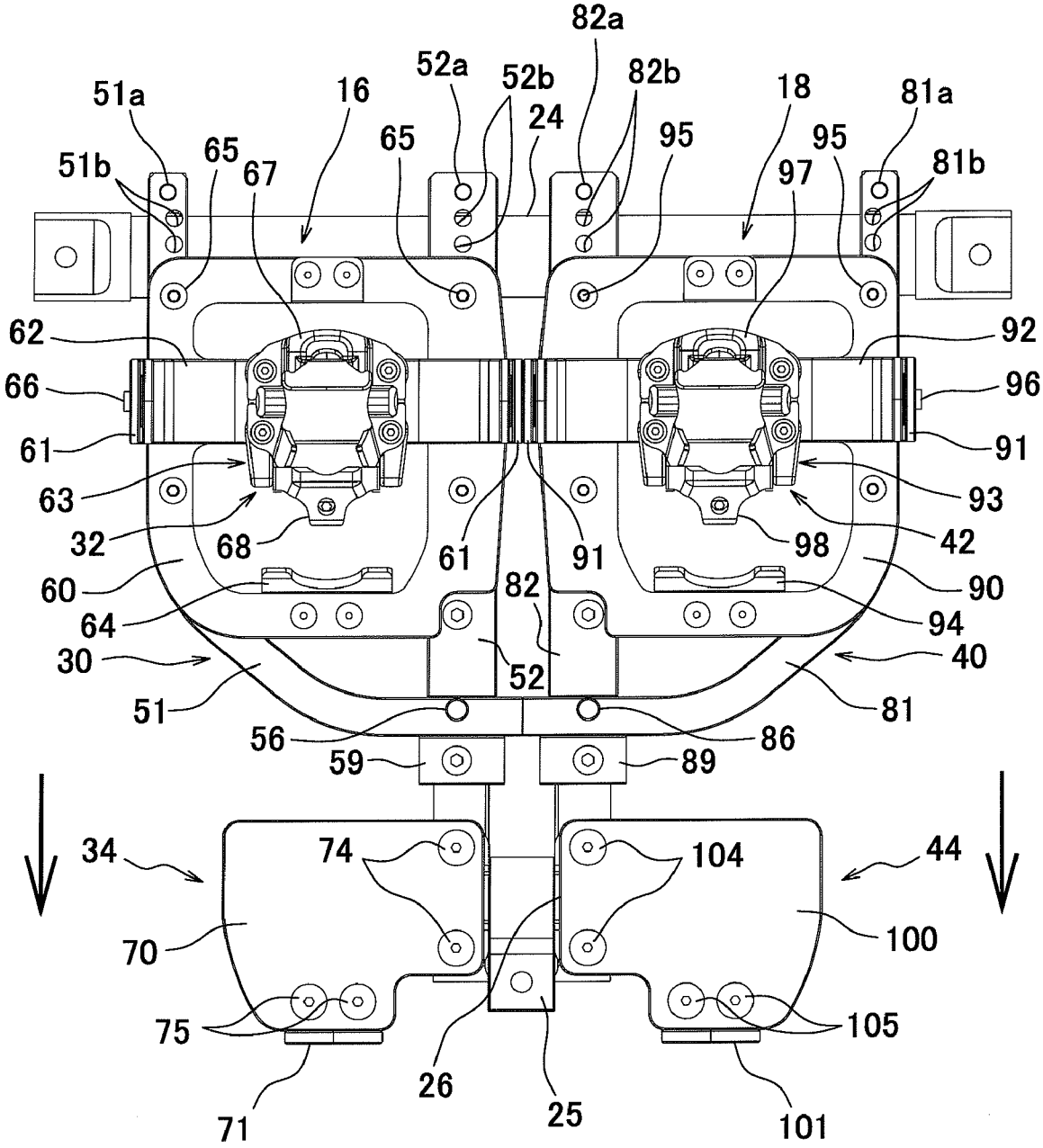
FIG. 10 is a oblique plan view, similar to FIG. 5, of the rowing boat footrest assembly, but with the heel support parts in second longitudinal heel positions with respect to the stationary boat mounting structure.

As explained below, the first and second footrest parts 32 and 42 are adjustably in a longitudinal direction of the rowing boat 10 to accommodate rowers with different lengths of feet. In the illustrated embodiment, the first and second footrest parts 32 and 42 are coupled to the first and second attachment parts 30 and 40, respectively, for independent adjustment in the longitudinal direction. FIGS. 5 to 8 illustrate a first longitudinal foot position of each of the first and second footrest parts 32 and 42 with respect to the first and second attachment parts 30 and 40, while FIGS. 9 and 10 illustrate a second longitudinal foot position of each of the first and second footrest part 32 and 42 with respect to the first and second attachment parts 30 and 40.

As best seen in FIGS. 11 to 16, the first attachment part 30 basically includes an outbound side support 51, an inbound side support 52 and a heel adjustment support 53. The first attachment part 30 is adjustably coupled to the stationary boat mounting structure 14 on a first lateral side of the stationary boat mounting structure 14 with respect to a vertical longitudinal center plane. The outbound and inbound side supports 51 and 52 are fixed together to form a U-shaped support member. In particular, the upper ends of the outbound and inbound side supports 51 and 52 are attached to the lateral cross support member 24 by a pair of upper attachment brackets 54 with two pairs of upper fasteners 55. The heel adjustment support 53 is attached to the lower ends of the outbound and inbound side supports 51 and 52 by a fixing fastener 56, a clamping bar 57, a pair of adjustment fasteners 58 and an end part 59.

The outbound side support 51 is a generally L-shaped member that is constructed of a hard rigid material. The longitudinally extending portion of the outbound side support 51 has two threaded bores 51*a* for attaching one of the upper attachment brackets 54, and has two spaced apart sets of four threaded adjustment holes 51*b* for attaching the first footrest part 32. The laterally extending portion of the outbound side support 51 has an opening 51*c* for attaching the inbound side support 52 as explained below.

The inbound side support 52 is a generally straight tubular member that is constructed of a hard rigid material. The inbound side support 52 has two threaded bores 52*a* for attaching one of the upper attachment brackets 54, and has two spaced apart sets of four threaded adjustment holes 52*b* for attaching the first footrest part 32. The inbound side support 52 also has a pair of aperture 52*c* for receiving the adjustment fasteners 58 and a fixing aperture 52*d* for receiving the fixing fastener 56, as explained below.

Figure 3:
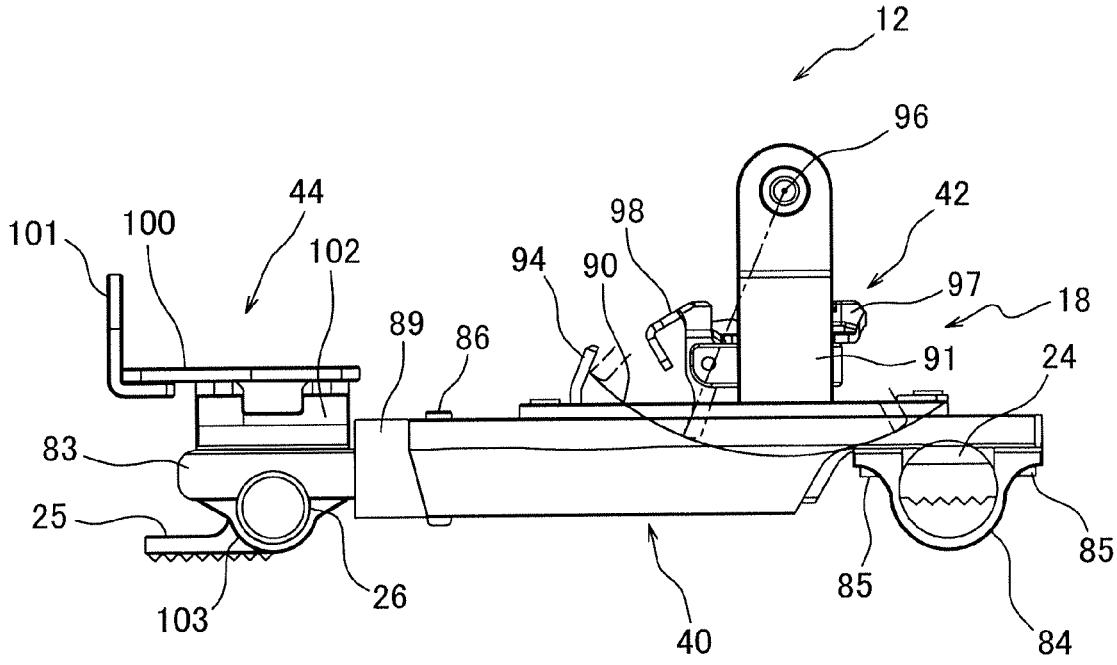
FIG. 3 is a side elevational view of the rowing boat footrest assembly illustrated in FIGS. 1 and 2.
Figure 4:
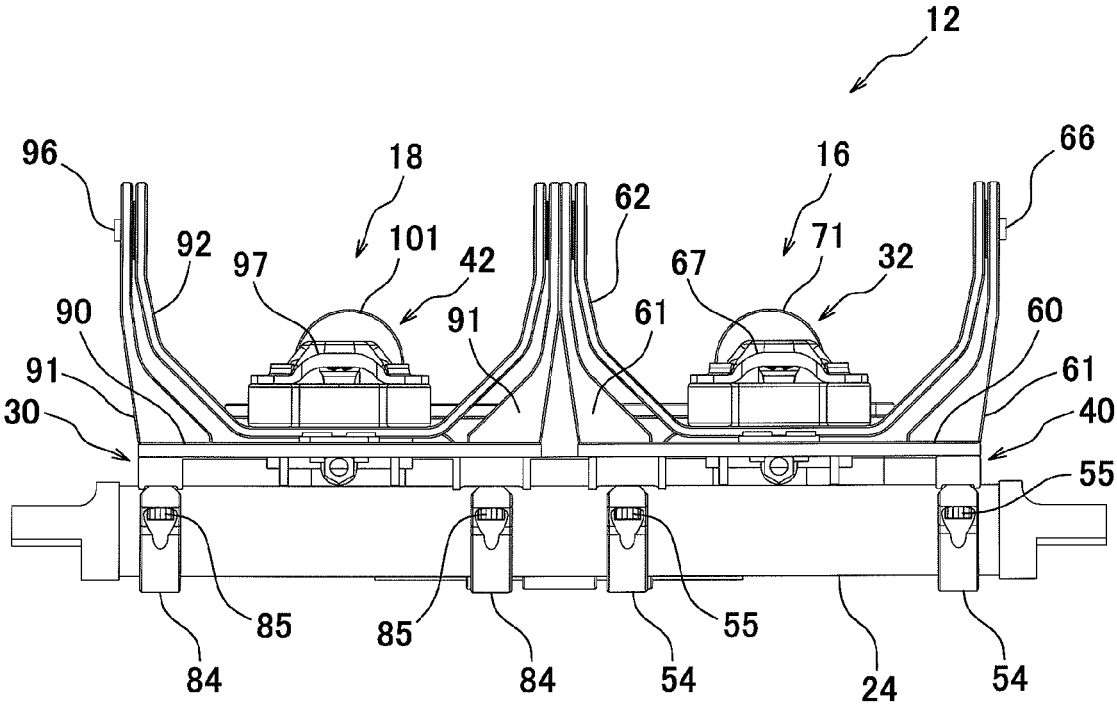
FIG. 4 is a rear oblique view of the rowing boat footrest assembly illustrated in FIGS. 1 to 3.
Figure 13:
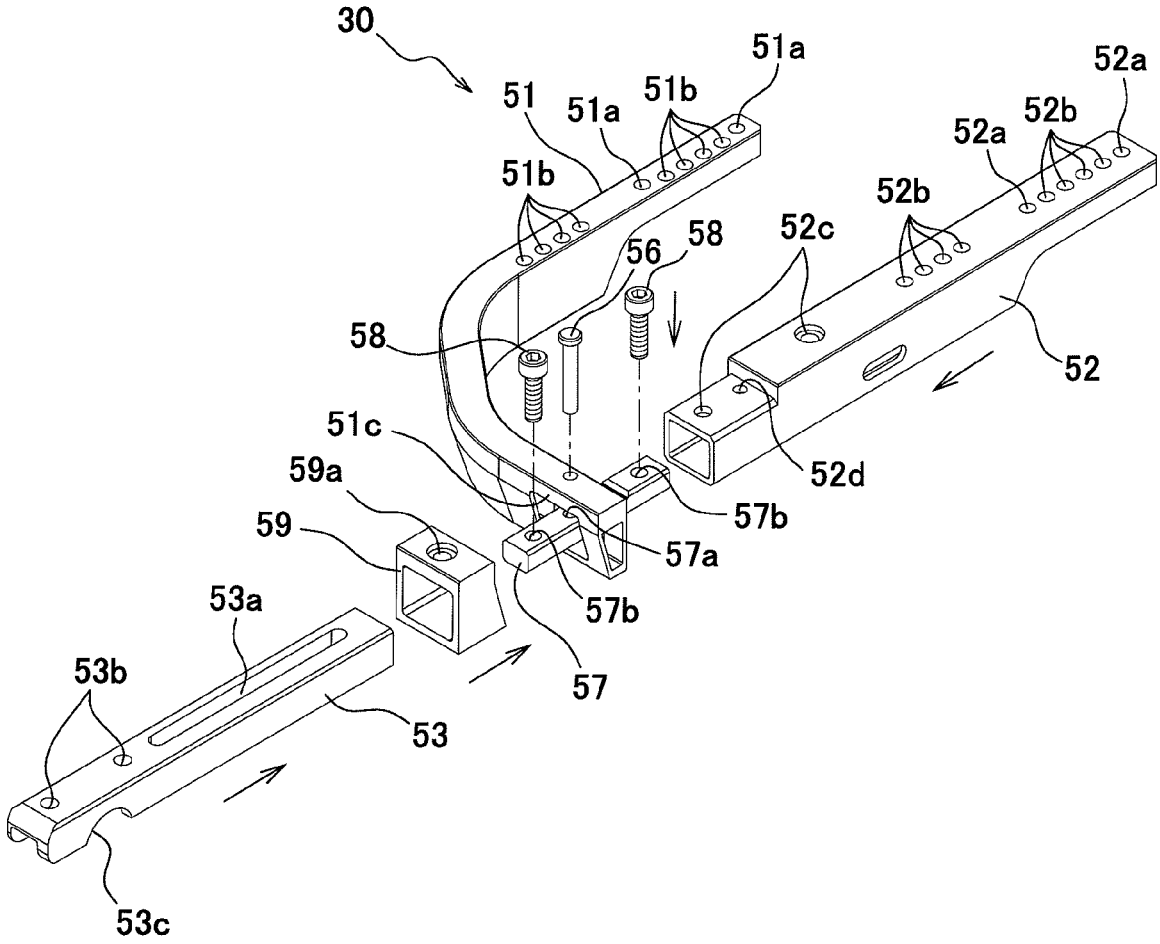
FIG. 13 is an exploded, perspective view of the first attachment part for the rowing boat footrest assembly illustrated in FIGS. 1 to 10.
Figure 14:
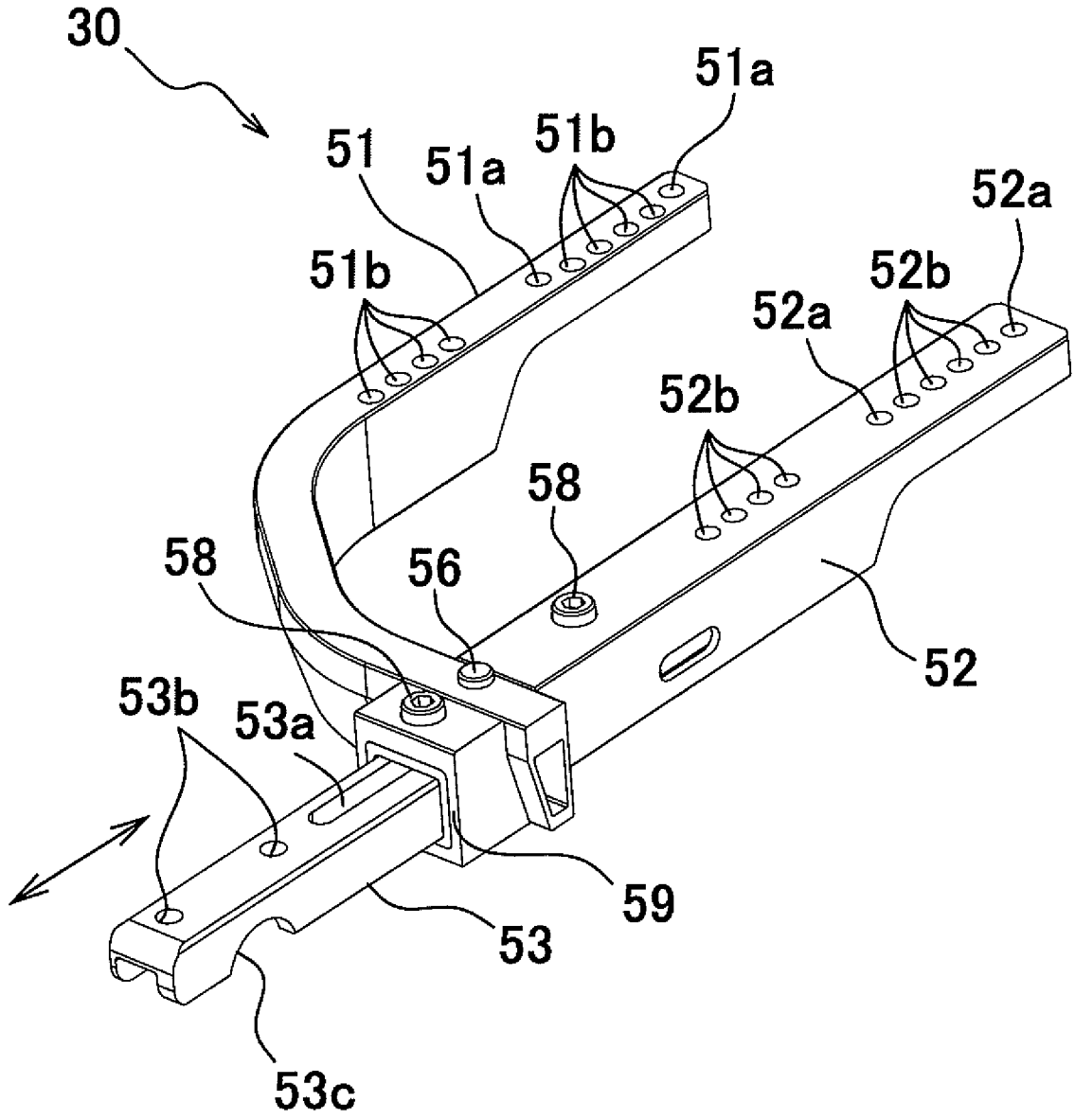
FIG. 14 is a perspective view of the first attachment part illustrated in FIG. 13 in a fully assembled condition.
Figure 15:
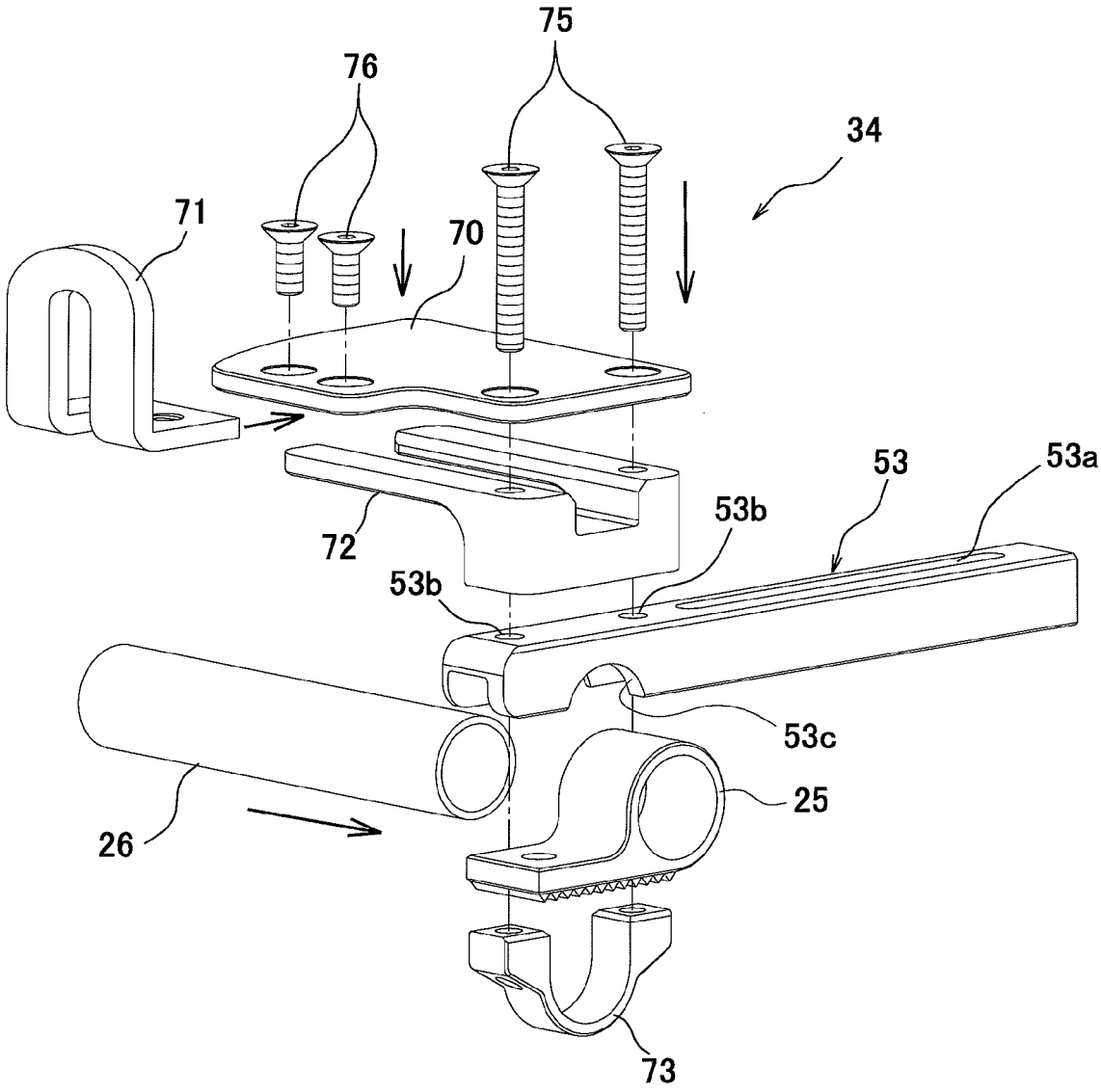
FIG. 15 is an exploded, perspective view of the first heel support part for the rowing boat footrest assembly illustrated in FIGS. 1 to 10.
Figure 16:
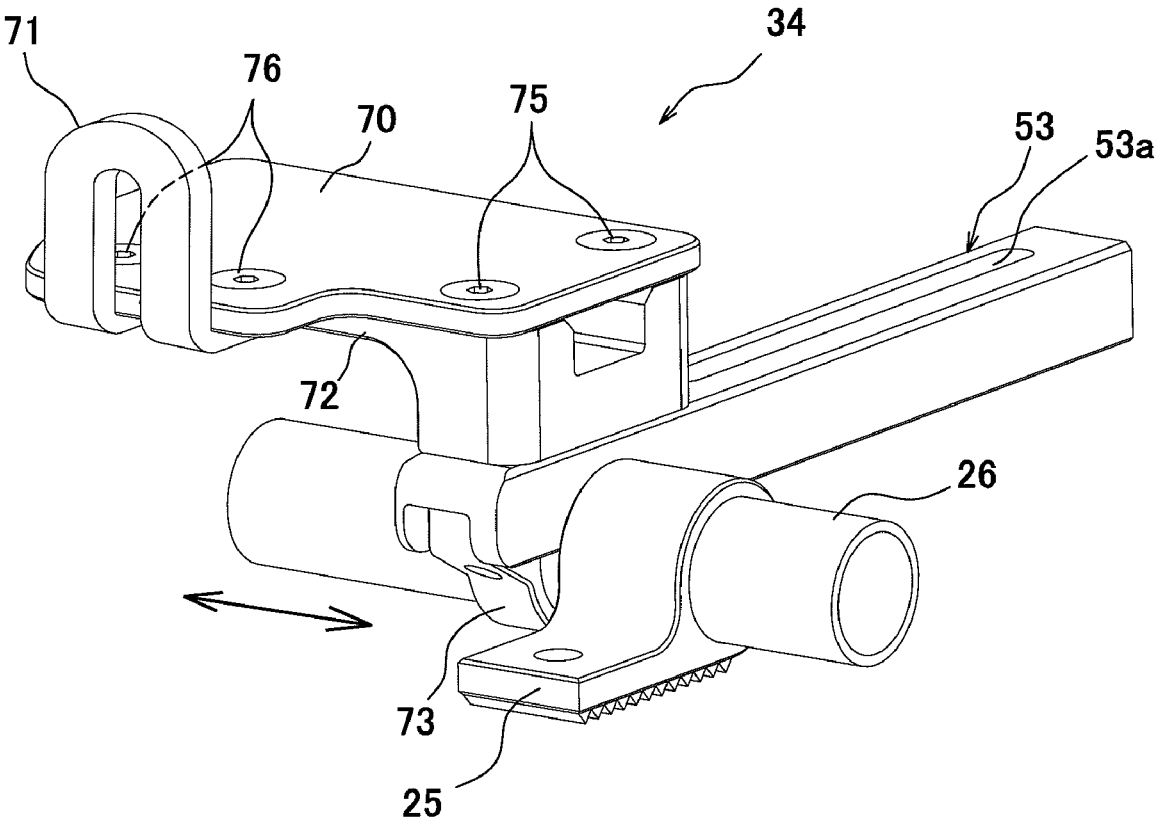
FIG. 16 is a perspective view of the first heel support part illustrated in FIG. 15 in a fully assembled condition.

In the illustrated embodiment, the fixing fastener 56 is a rivet (non-releasable fastener) that also secures the inbound side support 52 to the outbound side support 51 as seen in FIGS. 3, 13 and 14. The fixing fastener 56 also secures the clamping bar 57 to the outbound side support 51. In particular, the fixing fastener 56 passes through a center hole 57*a* of the clamping bar 57 such that the clamping bar 57 is slidably disposed on the shaft of the fixing fastener 56. When the clamping bar 57 is secured to the outbound and inbound side supports 51 and 52, half of the clamping bar 57 extends out of each side of the opening 51*c*. The inbound side support 52 is disposed in the receive the opening 51*c* of the outbound side support 51 with the fixing fastener 56 passing through the fixing aperture 52*d* to fixedly secure the inbound side support 52 to the outbound side support 51.

As best seen in FIGS. 13 and 14, the heel adjustment support 53 is a generally straight member that is constructed of a hard rigid material. The heel adjustment support 53 is telescopically coupled to the first attachment part 30. The heel adjustment support 53 has an elongated slot 53*a*, a pair of unthreaded bores 53*b* and an arc shaped cutout 53*c*. The heel adjustment support 53 is retained to the outbound and inbound side supports 51 and 52 by the fixing fastener 56 and the adjustment fasteners 58, which pass through the elongated slot 53*a*. The adjustment fasteners 58 also pass through the aperture 52*c* of the inbound side support 52 and an aperture 59*a* of the end part 59. Thus, the heel adjustment support 53 is slidably coupled to the first attachment part 30 as seen in FIG. 10. The adjustment fasteners 58 are threadedly received in threaded bores 57*b* of the clamping bar 57 such that tightening of the adjustment fasteners 58 causes the clamping bar 57 to squeeze (e.g., clamp) the heel adjustment support 53 against the interior surfaces of the inbound side support 52 and the end part 59. Thus, the heel adjustment support 53 is selectively locked in to one of a plurality of longitudinal heel positions.

Figure 11:
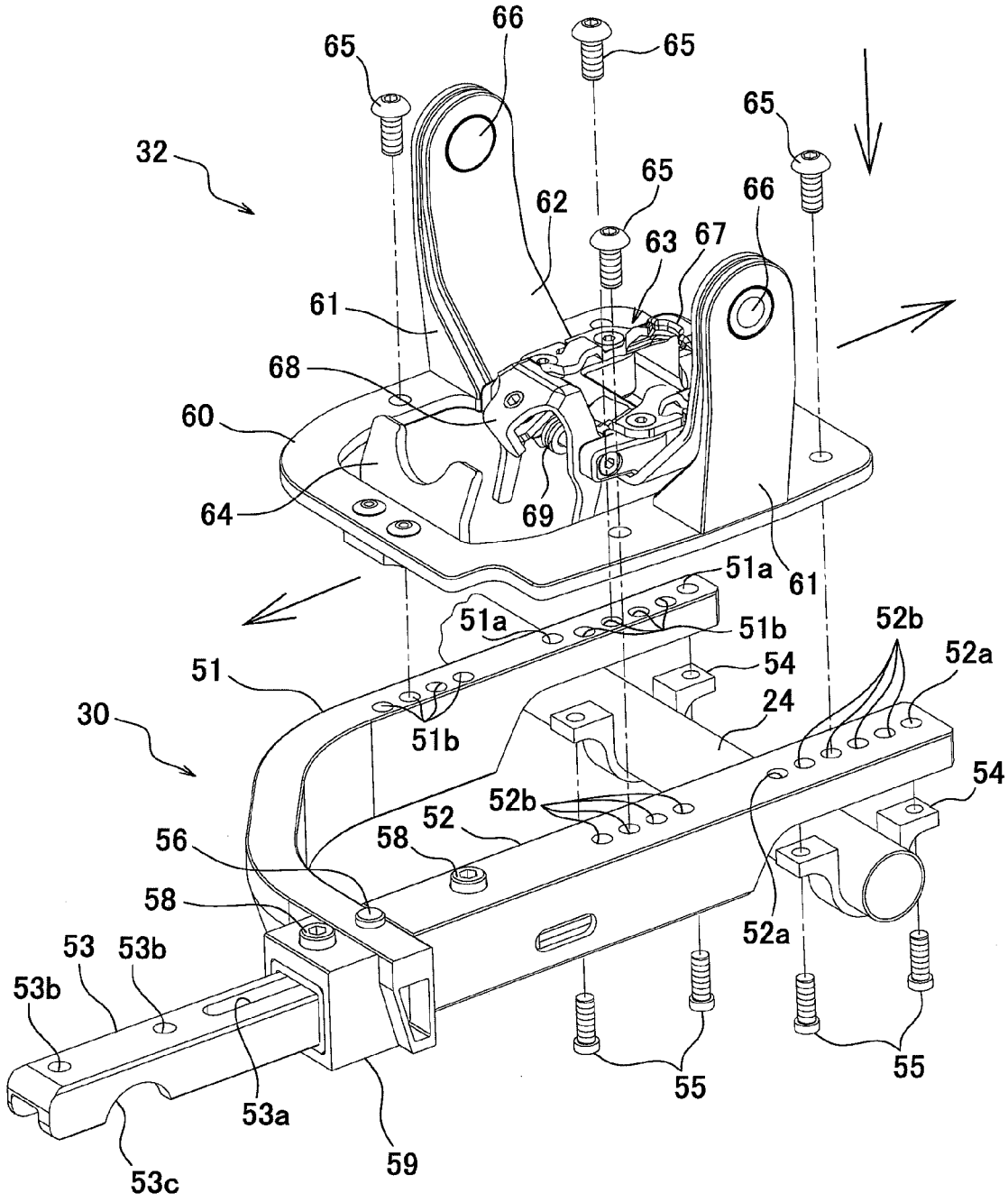
FIG. 11 is an exploded, perspective view of selected parts of the first shoe support unit for the rowing boat footrest assembly illustrated in FIGS. 1 to 10.
Figure 12:
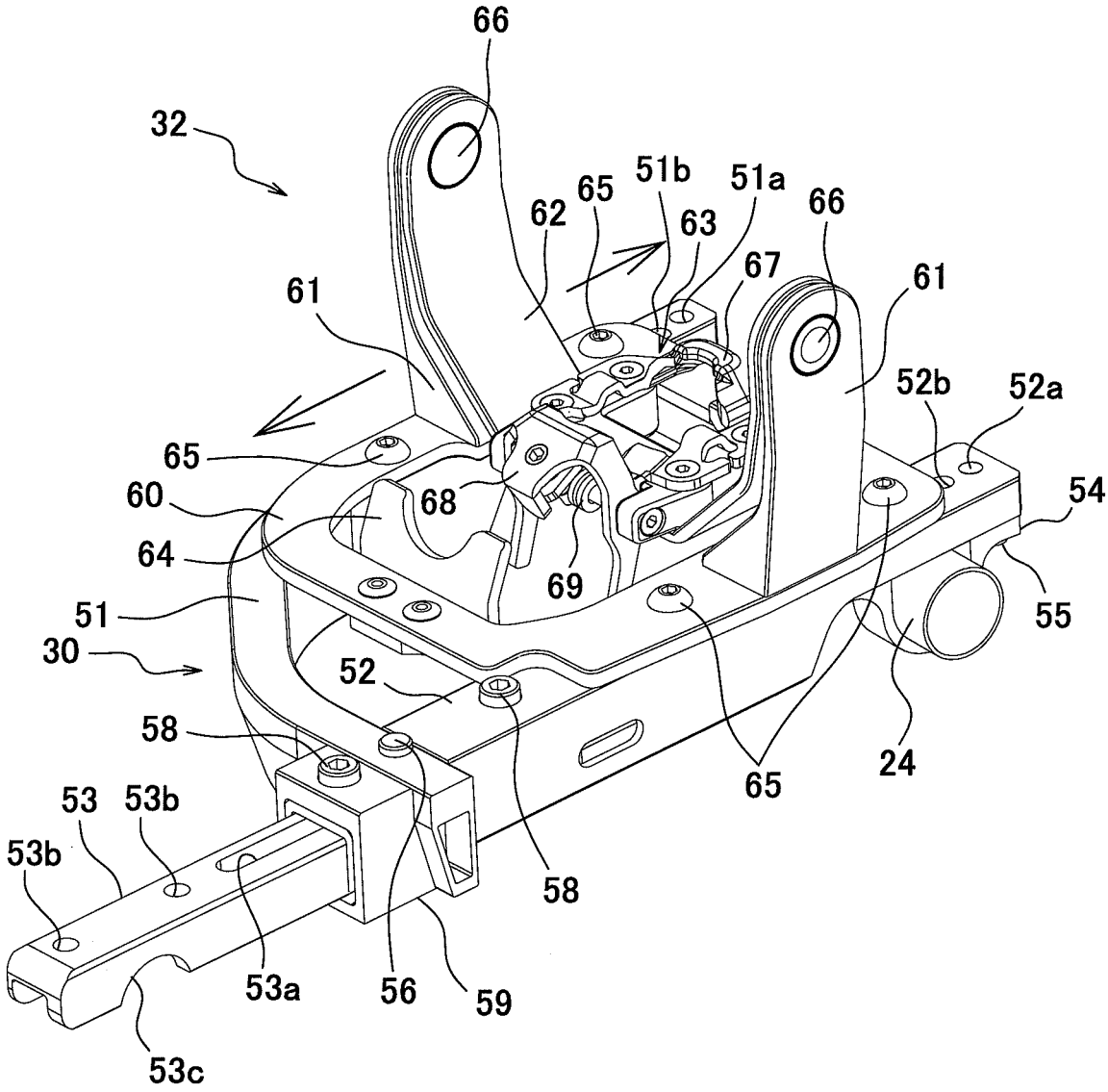
FIG. 12 is a perspective view of the selected parts of the first shoe support unit illustrated in FIG. 10 in a fully assembled condition.

As best seen in FIGS. 11 and 12, the first footrest part 32 is attached to the first attachment part 30. The first footrest part 32 basically includes a base plate 60, a pair of support pillars or flanges 61, a swing member 62, a step-in shoe attachment part 63 and a limiting member 64. The base plate 60 may be referred to as a first base plate, and the swing member 62 may be referred to as a first swing member. The base plate 60 is fixedly coupled to the outbound and inbound side supports 51 and 52 by four threaded fasteners or bolts 65 that thread into the threaded bores 51*b* and 52*b*. The threaded bores 51*b* and 52*b*, the base plate 60 and the bolts 65 constitute a longitudinal adjustment mechanism that is disposed between the first attachment part 30 and the first footrest part 32 to selectively secure the first footrest part 32 in at least two different longitudinal positions with respect to the first attachment part 30 while the first attachment part 30 remains secured to the stationary boat structure 14. In the illustrated embodiment, the outbound and inbound side supports 51 and 52 each have two sets of four adjustment holes formed by the threaded bores 51*b* and 52*b*. Thus, in the illustrated embodiment, the first footrest part 32 can be selectively secured to the first footrest part 32 in four different longitudinal foot positions. This longitudinal adjustment mechanism provides independent longitudinal adjustment of the first footrest part 32 in a longitudinal direction with respect to the second footrest part 42. While the longitudinal adjustment mechanism includes a plurality of adjustment holes (e.g., the threaded bores 51*b* and 52*b*) arranged in a longitudinal direction on the first attachment part 30 to provide longitudinal adjustment of the first footrest part 32, other adjustment mechanisms are possible such as using a pair of elongated slots instead of two sets of adjustment holes (e.g., the threaded bores 51*b* and 52*b*).

Still referring to FIGS. 11 and 12, the swing member 62 is pivotally attached to the support pillars 61 by a pair of pivot pins 66. The swing member 62 is a rigid U-shaped member. The pivot pins 66 extend through openings in the upper portions of the swing member 62 and the upper portions of the support pillars 61 with the center of the pivot pins 66 forming a pivot axis. The pivot axis of the swing member 62 is located above the step-in shoe attachment part 63. The limiting member 64 and the base plate 60 are arranged to limit swinging movement of the swing member 62 about the pivot pins 66 to a predetermined range of swinging movement while the step-in shoe attachment part 63 (i.e., shoe attachment mechanism, as discussed below) remains in a shoe attachment position as can be readily determined with reference to FIG. 3 and as discussed below with respect to the second footrest part 42. Specifically, the limiting member 64 limits swinging movement of the swing member 62 of the first footrest part 32 in one direction, while the base plate 60 limits swinging movement of the swing member 62 of the first footrest part 32 in the opposite direction, as can be readily determined with reference to FIG. 3 and as discussed below with respect to the second footrest part 42.

The step-in shoe attachment part 63 can be a conventional shoe attachment mechanism such as is used on a bicycle.

Specifically, the step-in shoe attachment part 63 can be a clipless type shoe pedal attachment mechanism, such as those disclosed in, for example, U.S. Pat. Nos. 6,925,908 and 6,119,551. In such a clipless type shoe attachment mechanism, a shoe includes a cleat or attachment part (not shown) that is releasably retained by the step-in shoe attachment part 63 in a conventional manner such that the shoe attachment part 63 remains in a shoe attachment position, thereby retaining the shoe, as the swing member 62 swings about the pivot pins 66 relative to the base plate 60. Basically, the step-in shoe attachment part 63 includes a front cleat retraining member 67, a rear cleat retraining member 68 and a biasing element 69. The step-in shoe attachment part 63 is attached to the lower portion of the swing member 62 below the pivot axis of the swing member 62.

As best seen in FIGS. 13 and 14, the first heel support part 34 is fixed to the heel adjustment support 53. The first heel support part 34 is adjustably coupled to the first attachment part 30 on the first lateral side of the stationary boat mounting structure 14 in a longitudinal direction via the telescopic arrangement of the heel adjustment support 53, as mentioned above. In the illustrated embodiment, the heel adjustment support 53 constitutes a telescopic member that telescopically couples the first heel support part 34 to the first attachment part 30 for movement in the longitudinal direction. FIGS. 6 to 9 illustrates the heel support part 34 in a first longitudinal heel position with respect to the stationary boat mounting structure 14, while FIG. 10 illustrates the heel support part 34 in a second longitudinal heel position with respect to the stationary boat mounting structure 14.

The first heel support part 34 basically includes a heel base plate 70, a heel end plate 71, a heel plate reinforcement 72, a lower attachment bracket 73 and a pair of upper fasteners 74. The upper fasteners 74 secure the heel base plate 70, the heel plate reinforcement 72 and the lower attachment bracket 73 together on the heel adjustment support 53. In particular, the upper fasteners 74 pass through the unthreaded bores 53*b* of the heel adjustment support 53. The heel base plate 70 and the heel end plate 71 are attached together by a pair of fasteners 75. The lateral cross support member 26 is squeezed between the arc shaped cutout 53*c* of the heel adjustment support 53 and the lower attachment bracket 73. Since the first heel support part 34 is fixed to the heel adjustment support 53, the first heel support part 34 moves with the heel adjustment support 53 when the heel adjustment support 53 is adjusted in the longitudinal direction. Thus, the first heel support part 34 is longitudinally adjustable with respect to the first attachment part 30 in the longitudinal direction. With this type of arrangement, an infinite number of longitudinal heel positions can be attained.

As explained above, the first and second shoe support units 16 and 18 are independent adjustably in a lateral direction with respect to the stationary boat mounting structure 14. Thus, the lateral width spacing between center points of the first and second footrest parts 32 and 42 can be adjusted. The first and second attachment parts 30 and 40 are directly attached to the lateral cross support members 24 and 26 of the stationary boat mounting structure 14.

As best seen in FIGS. 3 to 6, 17 and 18, the second attachment part 40 basically includes an outbound side support 81, an inbound side support 82 and a heel adjustment support 83. The second attachment part 40 is a mirror image of the first attachment part 30, and thus, the second attachment part 40 will not be described and/or shown in as much detail as the first attachment part 30. Basically, the second attachment part 40 is adjustably coupled to the stationary boat mounting structure 14 on a second lateral side of the stationary boat mounting structure 14 with respect to a vertical longitudinal center plane. The outbound and inbound side supports 81 and 82 are fixed together to form a U-shaped support member. In particular, the upper ends of the outbound and inbound side supports 81 and 82 are attached to the lateral cross support member 24 by a pair of upper attachment brackets 84 and two pairs of upper fasteners 85. The heel adjustment support 83 is attached to the lower ends of the outbound and inbound side supports 81 and 82 by a fixing fastener 86, a clamping bar 87, a pair of adjustment fasteners 88 and an end part 89.

The outbound side support 81 is a generally L-shaped member that is constructed of a hard rigid material. The longitudinally extending portion of the outbound side support 81 has two threaded bores 81*a* for attaching one of the upper attachment brackets 84, and has two spaced apart sets of four threaded adjustment holes 81*b* for attaching the second footrest part 42.

The inbound side support 82 is a generally straight tubular member that is constructed of a hard rigid material. The inbound side support 82 has two threaded bores 82*a* for attaching one of the upper attachment brackets 84, and has two spaced apart sets of four threaded adjustment holes 82*b* for attaching the second footrest part 42.

Figure 17:
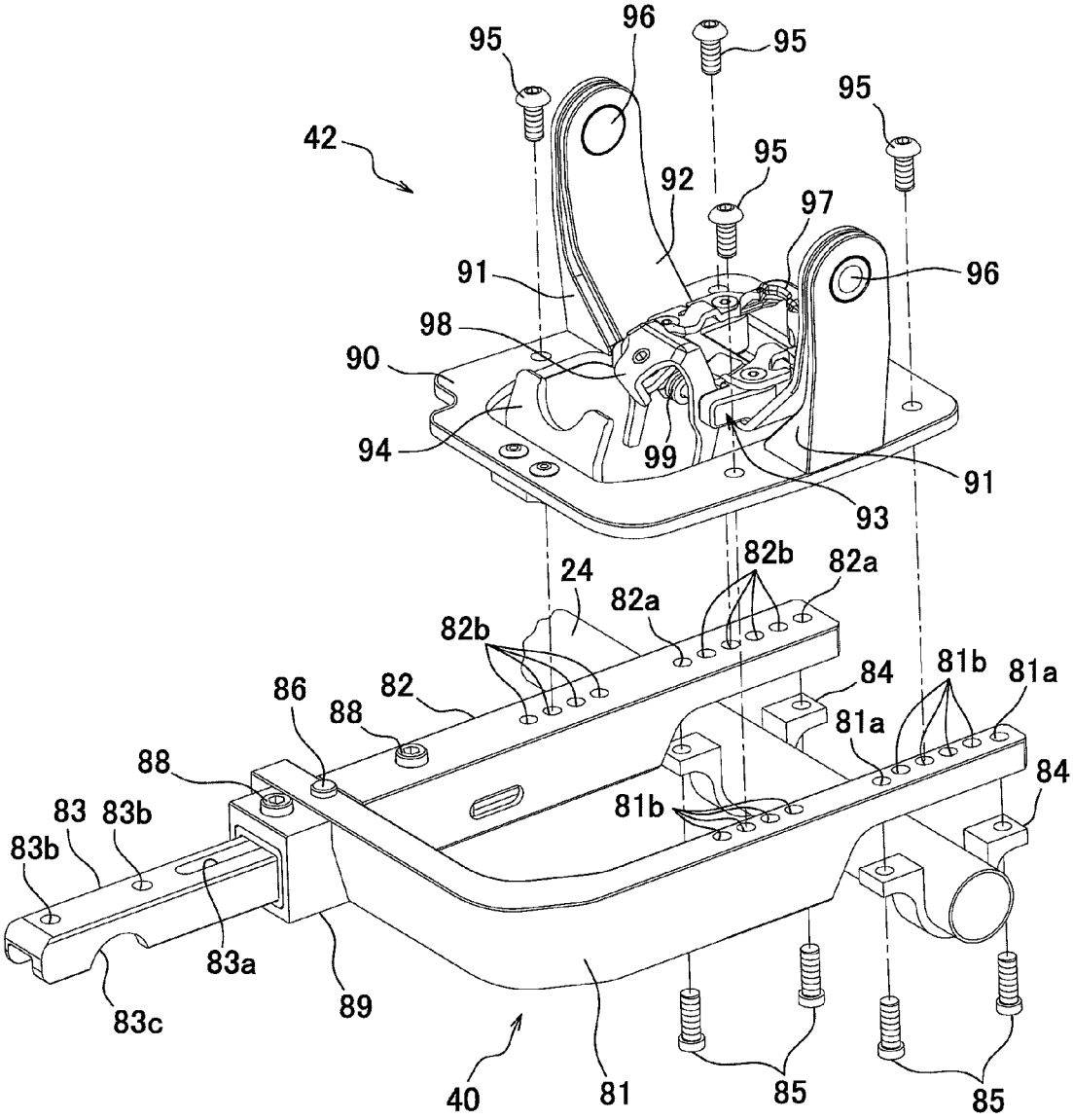
FIG. 17 is an exploded, perspective view of the second shoe support unit for the rowing boat footrest assembly illustrated in FIGS. 1 to 10.
Figure 18:
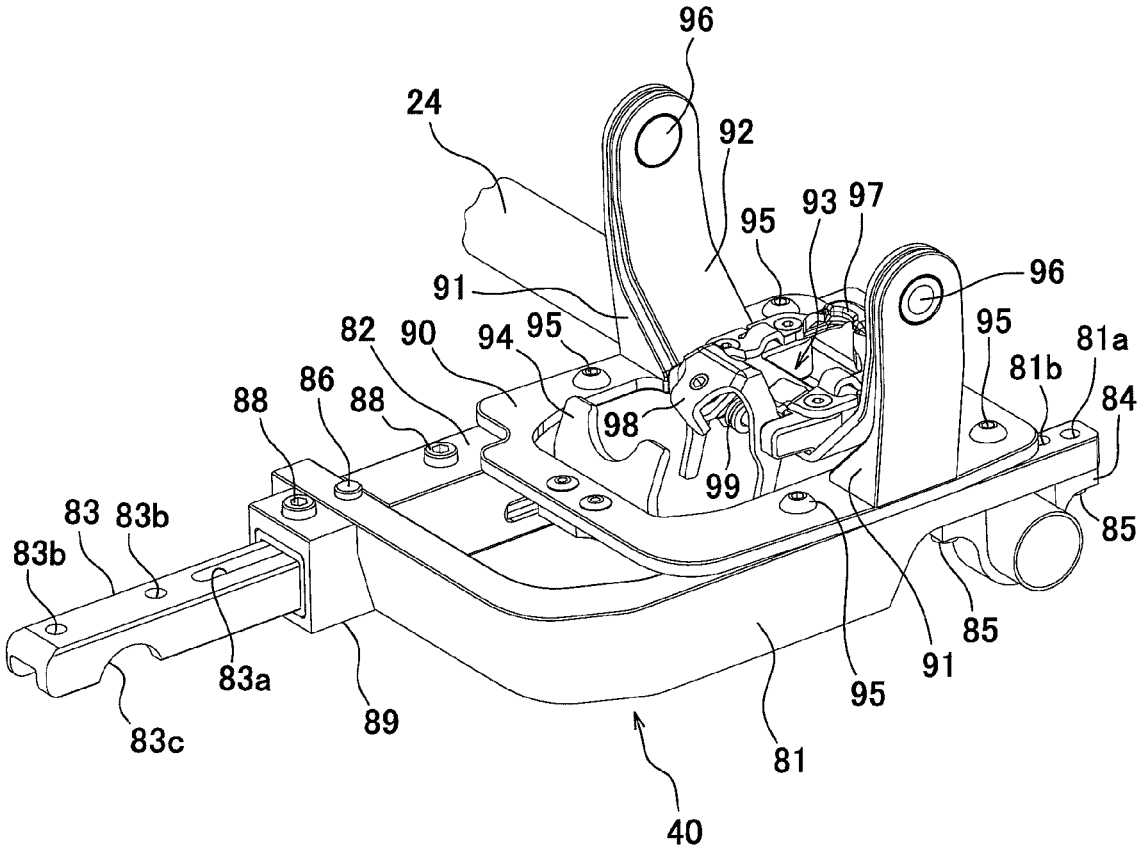
FIG. 18 is a perspective view of the second shoe support unit illustrated in FIG. 17 in a fully assembled condition.

As best seen in FIGS. 17 and 18, the heel adjustment support 83 is a generally straight member that is constructed of a hard rigid material. The heel adjustment support 83 is telescopically coupled to the second attachment part 40. The heel adjustment support 83 has an elongated slot 83*a*, a pair of unthreaded bores 83*b* and an arc shaped cutout 83*c*. The heel adjustment support 83 is retained to the outbound and inbound side supports 81 and 82 by the fixing fastener 86 and the adjustment fasteners 88, which pass through the elongated slot 83*a*. Thus, the heel adjustment support 83 is slidably coupled to the second attachment part 40 as seen in FIG. 10. The adjustment fasteners 88 are threadedly received in threaded bores of the clamping bar (not shown) such that tightening of the adjustment fasteners 88 causes the clamping bar (not shown) to squeeze (e.g., clamp) the heel adjustment support 83 against the interior surfaces of the inbound side support 82 and the end part 89. Thus, the heel adjustment support 83 is selectively locked in to one of a plurality of longitudinal heel positions.

As best seen in FIGS. 17 and 18, the second footrest part 42 is attached to the second attachment part 40. The second footrest part 42 basically includes a base plate 90, a pair of support pillars or flanges 91, a swing member 92, a step-in shoe attachment part 93 and a limiting member 94. The base plate 90 may be referred to as a second base plate, and the swing member 92 may be referred to as a second swing member. The base plate 90 is fixedly coupled to the outbound and inbound side supports 81 and 82 by four threaded fasteners or bolts 95 that thread into the threaded bores 81*b* and 82*b*. The threaded bores 81*b* and 82*b*, the base plate 90 and the bolts 95 constitute a longitudinal adjustment mechanism that is disposed between the second attachment part 40 and the second footrest part 42 to selectively secure the second footrest part 42 in at least two different longitudinal positions with respect to the second attachment part 40. In the illustrated embodiment, the outbound and inbound side supports 81 and 82 each have two sets of four adjustment holes formed by the threaded bores 81*b* and 82*b*. Thus, in the illustrated embodiment, the second footrest part 42 can be selectively secured to the second footrest part 42 in four different longitudinal foot positions. This longitudinal adjustment mechanism provides independent longitudinal adjustment of the second footrest part 42 in a longitudinal direction with respect to the first footrest part 32. While the longitudinal adjustment mechanism includes a plurality of adjustment holes (e.g., the threaded bores 81*b* and 82*b*) arranged in a longitudinal direction on the second attachment part 40 to provide longitudinal adjustment of the second footrest part 42, other adjustment mechanisms are possible such as using a pair of elongated slots instead of two sets of adjustment holes (e.g., the threaded bores 81*b* and 82*b*).

Still referring to FIGS. 17 and 18, the swing member 92 is pivotally attached to the support pillars 91 by a pair of pivot pins 96. The swing member 92 is a rigid U-shaped member. The pivot pins 96 extend through openings in the upper portions of the swing member 92 and the upper portions of the support pillars 91 with the center of the pivot pins 96 forming a pivot axis. The pivot axis of the swing member 92 is located above the step-in shoe attachment part 93. As shown in FIG. 3, the limiting member 94 and the base plate 90 are arranged to limit swinging movement of the swing member 92 about the pivot pins 96 to a predetermined range of swinging movement while the step-in shoe attachment part 93 (i.e., shoe attachment mechanism as discussed below) remains in a shoe attachment position as shown. Specifically, the limiting member 94 limits swinging movement of the swing member 92 in one direction by contacting a part of the step-in shoe attachment part 93, while the base plate 90 limits swinging movement of the swing member 92 in the opposite direction by contacting a part of the step-in shoe attachment part 93.

The step-in shoe attachment part 93 can be a conventional shoe attachment mechanism such as is used on a bicycle. Specifically, the step-in shoe attachment part 93 can be a clipless type shoe pedal attachment mechanism, such as those disclosed in, for example, U.S. Pat. Nos. 6,925,908 and 6,119,551. In such a clipless type shoe attachment mechanism, a shoe includes a cleat or attachment part (not shown) that is releasably retained by the step-in shoe attachment part 93 in a conventional manner. Basically, the step-in shoe attachment part 93 includes a front cleat retraining member 97, a rear cleat retraining member 98 and a biasing element 99. The step-in shoe attachment part 93 is attached to the lower portion of the swing member 92 below the pivot axis of the swing member 92. The second heel support part 44 is adjustably coupled to the second attachment part 40 on the second lateral side of the stationary boat mounting structure 14 in a longitudinal direction via the telescopic arrangement of the heel adjustment support 83, as mentioned above. In the illustrated embodiment, the heel adjustment support 83 constitutes a telescopic member that telescopically couples the second heel support part 44 to the second attachment part 40 for movement in the longitudinal direction. FIGS. 6 to 9 illustrates the heel support member 44 in a first longitudinal heel position with respect to the stationary boat mounting structure 14, while FIG. 10 illustrates the heel support member 44 in a second longitudinal heel position with respect to the stationary boat mounting structure 14.

As best seen in FIGS. 3 and 5 to 10, the second heel support part 44 basically includes a heel base plate 100, a heel end plate 101, a heel plate reinforcement 102, a lower attachment bracket 103 and a pair of upper fasteners 104. The upper fasteners 104 secure the heel base plate 100, the heel plate reinforcement 102 and the lower attachment bracket 103 together on the heel adjustment support 83. In particular, the upper fasteners 104 pass through the unthreaded bores 83*b* of the heel adjustment support 83. The heel base plate 100 and the heel end plate 101 are attached together by a pair of fasteners 105. The lateral cross support member 26 is squeezed between the arc shaped cutout 83*c* of the heel adjustment support 83 and the lower attachment bracket 103. Thus, the second heel support part 44 is laterally adjustable with respect to the second attachment part 40 in the lateral direction. With this type of arrangement, an infinite number of lateral heel positions can be attained. The second heel support part 44 is also independently adjustable in the longitudinal direction with respect to the first heel support part 34.

In this illustrated embodiment, as explained above, the lateral cross support members 24 and 26 together with the upper and lower attachment brackets 54, 84 and 73, 103 and the bolts 55, 74 and 85, 104 constitute a lateral adjustment mechanism disposed between the stationary boat mounting structure 14 and the first and second shoe support units 16 and 18 to selectively secure each of the first and second shoe support units 16 and 18 in at least two different lateral foot positions with respect to the stationary boat mounting structure 14. The lateral adjustment mechanism provides independent lateral adjustment of the first and second attachment parts 30 and 40 in the lateral direction. In this lateral adjustment mechanism, the upper and lower attachment brackets 54, 84 and 73, 103 and the bolts 55, 74 and 85, 104 constitutes a locking arrangement that selectively locks the first and second attachment parts 30 and 40 on the lateral cross support members 24 and 26, with the first and second attachment parts 30 and 40 being slidably supported on the lateral cross support members 24 and 26 when the locking arrangement is in an unlocked position. The locking arrangement includes a plurality of clamps formed by the upper and lower attachment brackets 54, 84 and 73, 103 and the bolts 55, 74 and 85, 104.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. As used herein to describe the rowing boat footrest assembly, the following directional terms "above, downward, vertical, horizontal, below and transverse" as well as any other similar directional terms refer to those directions of a rowing boat equipped with the rowing boat footrest assembly discussed above. Accordingly, these terms, as utilized to describe the rowing boat footrest assembly should be interpreted relative to a rowing boat equipped with the rowing boat footrest assembly as used in the normal rowing position. The term "releasable fastener" as used herein refers to a fastener that can be reused (i.e., installed, uninstalled and reinstalled) to fasten to or more parts together without significant damage. Finally, terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A rowing boat footrest assembly comprising:

a stationary boat mounting structure;

a shoe support including an attachment member adjustably coupled to the stationary boat mounting structure, and a footrest member attached to the attachment member, the footrest member including a base plate, a swing member arranged to swing relative to the base plate, and a shoe attachment mechanism attached to the swing member, with the shoe attachment mechanism remaining in a shoe attachment position as the swing member swings relative to the base plate through a predetermined range of swinging movement; and a lateral adjustment mechanism disposed between the stationary boat mounting structure and the shoe support to slidably mount the shoe support on the stationary boat mounting structure and the lateral adjustment mechanism being arranged to selectively secure the shoe support in at least two different lateral foot positions with respect to the stationary boat mounting structure.

2. The rowing boat foot support assembly according to claim 1, wherein the attachment member of the shoe support includes a first attachment part adjustably coupled to the stationary boat mounting structure on a first lateral side of the stationary boat mounting structure and a second attachment part adjustably coupled to the stationary boat mounting structure on a second lateral side of the stationary boat mounting structure, with the first and second attachment parts being independently adjustable with respect to the stationary boat mounting structure in a lateral direction, and the footrest member of the shoe support further includes a first footrest part mounted on the first attachment part, and a second footrest part mounted on the second attachment part.

3. The rowing boat foot support assembly according to claim 1, wherein the stationary boat mounting structure includes a lateral support arranged in a lateral direction, and the lateral adjustment mechanism selectively locks the attachment member on the lateral support, with the attachment member being slidably supported on the lateral support when the lateral adjustment mechanism is in an unlocked position.

4. The rowing boat foot support assembly according to claim 3, wherein the lateral adjustment mechanism includes at least one releasable fastener.

5. A rowing boat foot support assembly comprising:

a stationary boat mounting structure;

a shoe support including an attachment member adjustably coupled to the stationary boat mounting structure, and a footrest member attached to the attachment member; and a lateral adjustment mechanism disposed between the stationary boat mounting structure and the shoe support to slidably mount the shoe support on the stationary boat mounting structure and the lateral adjustment mechanism being arranged to selectively secure the shoe support in at least two different lateral foot positions with respect to the stationary boat mounting structure, the stationary boat mounting structure including a lateral support arranged in a lateral direction, and the lateral adjustment mechanism selectively locking the attachment member on the lateral support, with the attachment member being slidably supported on the lateral support when the lateral adjustment mechanism is in an unlocked position, the lateral support member including a pair of lateral support members arranged in the lateral direction, with the attachment member being slidably supported on the lateral support members when the locking arrangement is in the unlocked position.

6. The rowing boat foot support assembly according to claim 3, wherein the attachment member of the shoe support includes a first attachment part slidably coupled to the lateral support on a first lateral side of the stationary boat mounting structure and a second attachment part slidably coupled to the lateral support on a second lateral side of the stationary boat mounting structure, with the first and second attachment parts being independently adjustable with respect to the stationary boat mounting structure in the lateral direction, and the footrest member of the shoe support further includes a first footrest part mounted on the first attachment part, and a second footrest part mounted on the second attachment part.

7. The rowing boat foot support assembly according to claim 6, wherein the lateral adjustment mechanism includes at least one first releasable fastener coupling the first attachment part to the lateral support and at least one second releasable fastener coupling the second attachment part to the lateral support.

8. The rowing boat foot support assembly according to claim 7, wherein the lateral support includes at least one lateral support bar with the first and second releasable fasteners being clamps that releasably clamp to the at least one lateral support bar.

9. The rowing boat foot support assembly according to claim 1, wherein the attachment member and the footrest member further include a longitudinal adjustment mechanism formed between the attachment member and the footrest member to selectively secure the footrest member in at least two different longitudinal positions with respect to the attachment member.

10. The rowing boat foot support assembly according to claim 9, wherein the shoe support includes a heel support member telescopically coupled to the attachment member for adjustment in a longitudinal direction.

11. The rowing boat foot support assembly according to claim 1, wherein the shoe support includes a heel support member telescopically coupled to the attachment member for adjustment in a longitudinal direction.

12. A rowing boat foot support assembly comprising:

a stationary boat mounting structure;

a shoe support including an attachment member adjustably coupled to the stationary boat mounting structure, a first footrest member attached to the attachment member, and a second footrest member attached to the attachment member, the first footrest member having a first base plate and a first swing member arranged to swing relative to the first base plate, and the second footrest member having a second base plate and a second swing member arranged to swing relative to the second base plate, with the first and second footrest members being independently adjustable in a longitudinal direction; and a longitudinal adjustment mechanism disposed between the attachment member and the first and second footrest members to provide a longitudinal adjustment to selectively secure each of the first and second footrest members in at least two different longitudinal positions with respect to the attachment member, the longitudinal adjustment being independent of an adjustment between the attachment member and the stationary boat mounting structure such that the attachment member remains secured to the stationary boat mounting structure during the longitudinal adjustment.

13. The rowing boat foot support assembly according to claim 12, wherein the longitudinal adjustment mechanism includes a plurality of adjustment holes arranged in the longitudinal direction on the attachment member to provide the longitudinal adjustment of the footrest members.

14. The rowing boat foot support assembly according to claim 12, wherein the attachment member of the shoe support includes a first attachment part adjustably coupled to the lateral support on a first lateral side of the stationary boat mounting structure and a second attachment part adjustably coupled to the lateral support on a second lateral side of the stationary boat mounting structure, with the first and second attachment parts being independently adjustable with respect to the stationary boat mounting structure in a lateral direction.

15. A rowing boat foot support assembly comprising:

a stationary boat mounting structure; and a shoe support including an attachment member adjustably coupled to the stationary boat mounting structure, a footrest member attached to the attachment member, a heel support member telescopically coupled to the attachment member for adjustment in a longitudinal direction, the attachment member of the shoe support including a first attachment part adjustably coupled to the shoe support on a first lateral side of the stationary boat mounting structure and a second attachment part adjustably coupled to the shoe support on a second lateral side of the stationary boat mounting structure, the footrest member of the shoe support further including a first footrest part mounted on the first attachment part, and a second footrest part mounted on the second attachment part, and the heel support member of the shoe support further including first and second heel support parts that are independently adjustable to the first and second attachment parts in the longitudinal direction.

16. The rowing boat foot support assembly according to claim 15, wherein the first and second attachment parts are independently adjustable with respect to the stationary boat mounting structure in a lateral direction.

17. The rowing boat foot support assembly according to claim 15, wherein the first and second footrest parts are independently adjustable with respect to the stationary boat mounting structure in the longitudinal direction.

* * * * *